United States Patent [19]

Baker

[11] Patent Number: 4,806,120

[45] Date of Patent: Feb. 21, 1989

[54] ELECTRICAL TERMINAL

[75] Inventor: Robert W. Baker, Harrow, United Kingdom

[73] Assignee: AMP Incorporated, Harrisburg, Pa.

[21] Appl. No.: 145,423

[22] Filed: Jan. 19, 1988

[30] Foreign Application Priority Data

Feb. 16, 1987 [GB] United Kingdom ..... 8703551

[51] Int. Cl.[4] ..... H01R 4/24

[52] U.S. Cl. ..... 439/399; 439/407; 439/436

[58] Field of Search ..... 439/387–401, 439/404, 406, 407, 408, 420, 426, 435–441, 443, 819, 833, 839, 856, 857, 858, 847

[56] References Cited

U.S. PATENT DOCUMENTS

| | | | |
|---|---|---|---|
| 3,760,331 | 9/1973 | Gurley | 339/36 |
| 3,867,005 | 2/1975 | Hoppe, Jr. | 339/98 |
| 3,993,391 | 11/1976 | VErnerey et al. | 339/97 |
| 4,040,702 | 8/1977 | McKee et al. | 339/97 |
| 4,040,713 | 8/1977 | Könnemann | 339/259 R |
| 4,125,311 | 11/1978 | Hoppe, Jr. | 339/97 R |
| 4,385,794 | 5/1983 | Lucius | 339/97 R |
| 4,480,385 | 11/1984 | Dragisic | 29/866 |
| 4,540,235 | 9/1985 | Lolic | 339/259 F |
| 4,575,173 | 3/1986 | Chapin et al. | 339/97 R |
| 4,583,812 | 4/1986 | Gross, Jr. et al. | 439/839 |
| 4,660,917 | 4/1987 | De Ross et al. | 339/97 R |
| 4,679,876 | 7/1987 | Regla et al. | 439/426 |

OTHER PUBLICATIONS

AMP Incorporated Catalogue, HD-7, Jul. 1987.

AMP Incorporated Product Manual, PM5313, Dec. 1978.

AMP Incorporated Handbook, HB5351, Rev. D, 1987.

*Primary Examiner*—David Pirlot

*Attorney, Agent, or Firm*—Bruce J. Wolstoncroft; Thomas G. Terrell

[57] ABSTRACT

The connector has a body part (4) of good electrical conductivity and which is of U-shaped cross section. A pair of wings (18) extend from one or both ends of the side walls (16) of the body part (4) and define a wire slot (20). The wings (18) are not connected to the base (12) of the body part (4), so as to allow the side walls (16) of the body part (4) to be deflected away from each other. A U-section spring (10) receiving the part (4), and being separated therefrom, resiliently restrains deflection of the side walls (16) of the body part (4) away from each other, when a wire (W) is inserted into the wire slot or wire slots (20). The spring part (10) stores energy so as to maintain the integrity of the electrical connection between the edges of the slot or slots (20) and the core (C) of the wire (W), despite temperature cycling. The spring characteristics of the spring part (10) can be selected to achieve a desired contact force.

11 Claims, 1 Drawing Sheet

ELECTRICAL TERMINAL

Figure 1:
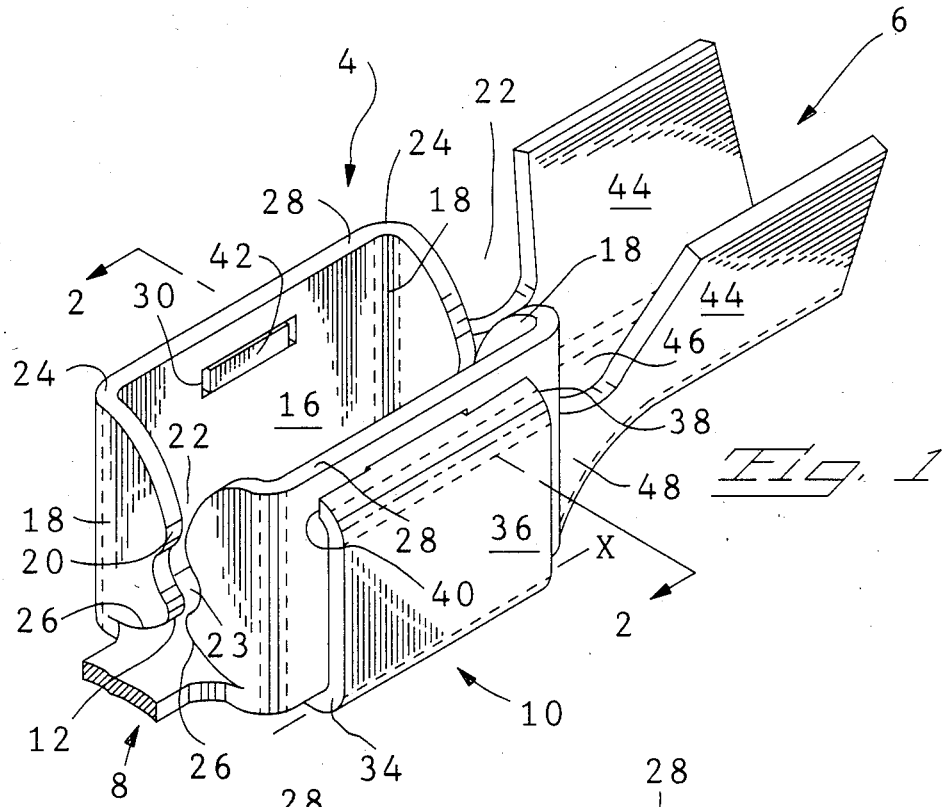

This invention relates to an electrical terminal having a body part which has been stamped and formed from a piece of sheet metal and is of substantially U-shaped cross section and thus comprises a base from opposite edges of which upstand a pair of opposed side walls, each side wall having an extension thereof projecting towards the other side wall, the extensions cooperating to define a wire receiving slot extending normally of the base and between the side walls and having a wire receiving mouth opening in a direction away from the base, each side wall together with the extension thereof, being deflectable away from the other side wall as a result of a wire being forced into the wire receiving slot by way of its wire receiving mouth. Such a terminal is described in U.S. Pat. No. 4,385,794.

In that terminal, indents are formed in the side walls and in the base, at the junctions between the side walls and the base, to restrain deflection of the side walls away from one another as a wire is inserted into the wire receiving slot.

The present invention is intended to provide a terminal of the same general kind as that described above, but in which the retention of the wire in firm electrical contact with the walls of the slot over long periods of use, and despite temperature cycling, is improved, and which is usable over a greater wire gauge range than the known terminal, being particularly suitable for use with large gauge wires, for conducting heavy current.

An electrical terminal according to one aspect of the present invention, has a body part which has been stamped and formed from a piece of sheet metal, the body part being of substantially U-shaped cross section and thus comprising a base from opposite edges of which upstand a pair of opposed sidewalls, each sidewall having an extension thereof projecting towards the other sidewall, the extensions cooperating to define a wire receiving slot extending normally of the base and between the two side walls and having a wire receiving mouth opening in a direction away from the base, each side wall, together with the extension thereof, being deflectable away from the other side wall as a result of a wire being forced into the wire receiving slot through the wire receiving mouth thereof, the terminal further having a spring part which is separate from the body part and which has been stamped and formed from a spring metal, the spring part being also of substantially U-shaped cross section and thus comprising a base from opposite edges of which upstand a pair of opposed side walls, the base of the body part overlying that of the spring part and the side walls of the spring part engaging the side walls of the body part resiliently to restrain deflection thereof away from each other, whereby a wire, when inserted into the wire receiving slot is tightly constrained between the extensions of the side walls of the body part.

The spring characteristics of the spring part can be selected in accordance with the gauge of the wire and the contact force that is required to be exerted against it. The spring part resiliently supports the body part as the wire is forced into the slot, and during subsequent temperature cycling, and stores the energy required to maintain the desired contact force.

The extensions of the side walls of the body part may be so formed that the slot has a laterally enlarged portion between its wire receiving mouth and the base of the body part to provide a wire strand retaining nest thereby to increase the tolerance of the terminal, in respect of wires which are stranded. Where the wire is in insulated wire, the walls of the slot serve as insulation piercing members to incise the insulation of the wire as it is forced into the slot and thereby to make firm electrical contact with the electrically conductive core of the insulated wire.

Conveniently, the edges of the side walls of the spring part, which are remote from the base thereof, are formed with tabs or other projections which engage in complimentary openings in the side walls of the body part. The edges of the side walls of the body part and of the spring part, which edges are remote from the base are preferably proximate to each other so as to maximize the level length of the side walls of the spring part.

According to another aspect of the invention an elongate electrical terminal has an elongate body part which has been stamped and formed from a piece of sheet metal of high electrical conductivity, the body part being of substantially U-shaped cross section and thus comprising a base from opposite longitudinal edges of which upstand a pair of opposed side walls, each side wall having at each end thereof an extension projecting towards the other side wall and towards, and opposite to, a respective extension thereof, the extensions of each pair of opposed pair of extensions cooperating to define a wire receiving slot extending normally to the base and between the two side walls and having a wire receiving mouth opening in a direction away from the base, each side wall together with the extensions thereof, being deflectable away from the other side wall, as a result of a wire being forced into the wire receiving slots through the wire receiving mouths thereof, the terminal further comprising a spring part which is separate from the body part and which has been stamped and formed from spring metal, the spring part being elongate and being of substantially U-shaped cross section and thus comprising a base from opposite edges of which upstand a pair of opposed side walls, the base of the body part overlying the base of the spring part, and the sidewalls of the spring part having in-turned longitudinal edge portions which extend longitudinally of the body part and which engage the outer surfaces of the side walls thereof, thereby resiliently to restrain the deflection of the side walls of the body part, away from each other, whereby a wire when inserted into the wire receiving slots is tightly constrained between the extensions of the side walls of the body part.

Figure 2:
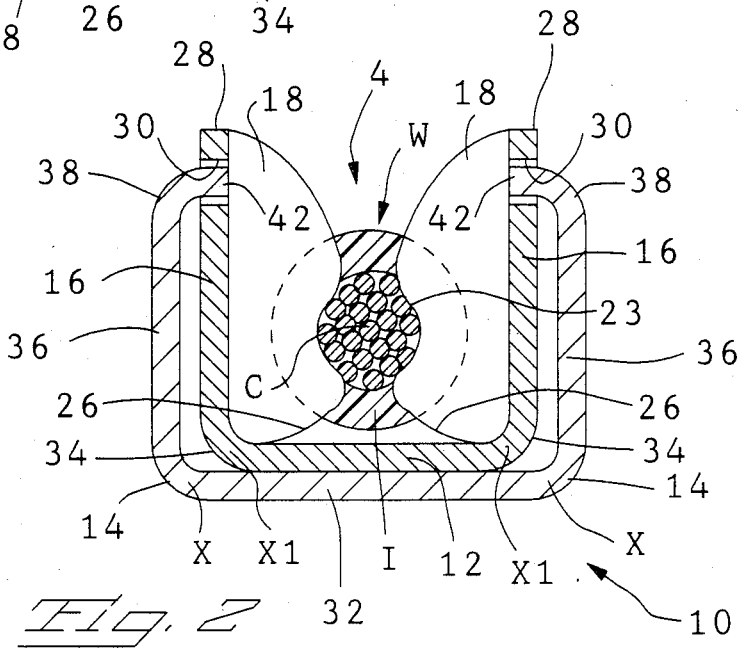

For a better understanding of the present invention and to show how it may be carried into effect, reference will now be made by way of example to the following drawings in which:

FIG. 1 is an isometric view of an electrical terminal, with part omitted; and FIG. 2 is a view taken on the lines 2—2 of FIG. 1.

The terminal comprises a body part 4, an insulation crimping part 6, a mating part 8, which may be in the form of a tab or a receptacle and of which only a transition portion is shown. The parts 4, 6 and 8 have been stamped and formed from a single piece of sheet metal stock of high electrical conductivity. The terminal further comprises a spring part 10 which has been stamped and formed from a single piece of spring metal stock.

The body part 4, which is of substantially U-shaped cross section, comprises an elongate, planar, base 12 from opposite longitudinal edges 14 (FIG. 2) of which upstand a pair of opposed, planar, sidewalls 16, normally of the base 12, each sidewall 16 having at each end thereof an extension in the form of a wing 18 extending normally of the sidewall 16 towards the other sidewall 16, the wings 18 at each end of the body part 4 being coplanar and thus being opposed to one another. The wings 18 of each opposed pair, cooperate to define a wire receiving slot 20 extending normally of the base 12 and between the sidewalls 16, each slot 20 having a wire receiving mouth 22. Each slot 20 has a laterally enlarged portion between its mouth 22 and base 12, providing a wire strand retaining nest 23. Each wing 18 is connected to its sidewall 16 by way of a bite 24 but is not connected to the base 12, although parts of the lower edges 26 of the wings 18 are contiguous therewith. Proximate to its longitudinal edge 28, which is remote from the base 12, each sidewall 16 is formed with a central longitudinal through slot 30.

The spring part 10 which is also of substantially U-shaped cross-sectional shape comprises a base 32 from opposite edges 34 of which upstand a pair of opposed, identical sidewalls 36 each overlying the outer face of a respective sidewall 16. The base 32 of the spring part 10 underlies the outer surface of the base 12. Each sidewall 36 has a turned over edge portion 38 which is remote from the base 32 and projects towards the respective sidewall 16. Each edge portion 38 has a free edge 40 which is contiguous with said sidewall 16 and from which projects a lug 42 which is received in the slot 30 of the sidewall 16 whereby the part 10 is releasably connected to the part 4. Between the base 32 and its edge portion 38, each sidewall 36 is planar, the portion 88 serving to stand-off the planar part of the sidewall 36 from outer surface of the adjacent sidewall 16. Since the sidewalls 36 extend over the sidewalls 16 over most of their height, the sidewalls 36 have a desirably long lever length.

The insulation crimping part 6 of the terminal is in the form of an insulation barrel comprising a pair of ears 44 which upstand from, and diverge slightly in a direction away from, a base 46. The part 6 is connected to the part 4 by way of a transition portion 48.

In the use of the terminal, an insulated wire W having an electrically conductive multistranded core C surrounded by insulation I is forced into both of the wire slots 20 simultaneously, in a direction at right angles to the longitudinal axis of the wire W, by way of the wire receiving mouths 22, until the core C of the wire W is received in the strand restraining nests 23 of the wire slots 20. During the insertion of the wire W into the wire slots 20, the edges thereof pierce the insulation of the wire W to make firm electrically conductive contact with its electrically conductive core C. As mentioned above, the wings 18 are connected to the base 12. Thus, during the insertion of the wire W, the core C of which is oversized with respect of the nests 23, the sidewalls 16 of the body part 4 are deflected away from one another against the resilient action of the spring part 10 about an axis X1 extending along the junctions between the sidewalls 16 and the base 12, whereby the sidewalls 36 of the spring part 10 are deflected angularly away from one another about an axis X extending along their junctions with the base 32 of the part 10. The inserted wire W also lies between the ears 44 of the part 6 and these are curled over towards one another to embrace the insulation I of the wire W in order to provide strain relief for the electrical connections between the core C and the body part 4. The insertion of the wire W and the curling over of the ears 44 are performed int he same operation by means of tooling (not shown).

The spring part 10 serves, in the finished connection, to store the energy required for it to continue to urge the sidewalls 16 of the body part 4, towards one another so that the edges of the nest 23 of the slots 20 continue to constrict the core C, despite the influencé of temperature variations to which the finished connection may be subjected. Since, by virtue of the provision of the spring part 10, the sidewalls 16 may be deflected to a very considerable extent as a result of the extension of the wire W, without taking on a permanent set, the terminal may be used with a large range of different wire gauges. As the spring part 10 is separate from the body part 4, it can be designed to have a spring characteristic which will produce a desired contact force between the edges of the nest 23 and the core C of the wire W. For the same reason the remainder of the terminal can be made of a high conductivity material, without affecting the contact force.

I claim:

1. An electrical terminal having a body part which has been stamped and formed from a piece of sheet metal, the body part being of substantially U-shaped cross section and thus comprising a base from opposite edges of which upstand a pair of opposed side walls, each side wall having an extension thereof projecting towards the other side wall, the extensions cooperating to define a wire receiving slot extending normally of the base and between the two side walls and having a wire receiving mouth opening in a direction away from the base, each side wall together with the extension thereof, being deflectable away from the other side wall as a result of a wire being forced into the wire receiving slot through the wire receiving mouth thereof, the terminal further having a spring part which is separate from the body part and which has been stamped and formed from a spring metal, the spring part also being a substantially U-shaped cross section and thus comprising a base from opposite edges of which upstand a pair of opposed side walls, the base of the body part overlying that of the spring part and the side walls of the spring part engaging the side walls of the body part resiliently to restrain deflection thereof away from each other, the spring part is releasably connected to the body part by means of projections thereon which engage in openings in the side walls of the body part whereby, a wire when inserted into the wire receiving slot is tightly constrained between the extensions of the sidewalls of the body part.

2. A terminal as claimed in claim 1, wherein the side walls of the spring part engage the side walls of the body part at a position proximate to those edges of the body part which are remote from the base thereof.

3. A terminal as claimed in claim 1, wherein the openings are in the form of slots formed in the side walls of the body part at positions proximate to those edges of the side walls which are remote from the base of the body part.

4. A terminal as claimed in claim 1, wherein the wire receiving slot is formed with a laterally enlarged wire strand next between the wire receiving mouth of the slot and the base of the body part.

5. A terminal as claimed in claim 1, wherein the side walls of the body part are planar and extend normally of the base of the body part, the side walls of the spring part each having a repetitive portion engaging the outer face of a respective side wall of the body part but being otherwise parallel to the respective side wall.

6. An elongated electrical terminal having an elongate body part which has been stamped and formed from a piece of sheet metal of high electrical conductivity, the body part being of substantially U-shaped cross section and thus comprising a base from opposite longitudinal edges of which upstand a pair of opposed side walls, each side wall having at each end thereof an extension projecting towards the other side wall and towards, and opposite to, a respective extension thereof, the extensions of each pair of opposed extensions cooperating to define a wire receiving slot extending normally of the base and between the two side walls and having a wire receiving mouth opening in a direction away from the base, each side wall together with the extensions thereof, being deflectable away from the other side wall, as a result of a wire being forced into the wire receiving slot through the wire receiving mouths thereof, the terminal further comprising a spring part which is separate from the body part and which has been stamped and formed from spring metal, the spring part being elongate and being of substantially U-shaped cross section and thus comprising a base from opposite edges of which upstand a pair of opposed side walls, the base of the body part overlying the base of the spring part, and the side walls of the spring part having in-turned longitudinal edge portions which extend longitudinally of the body part and which engage the outer surfaces of the side walls thereof, thereby resiliently to restrain the deflection of the side walls of the body part, away from each other, whereby a wire when inserted into the wire receiving slot is tightly constrained between the extensions of the side walls of the body part.

7. A terminal as claimed in claim 6, wherein the side walls of the spring part engage the side walls of the body part at a position proximate to those edges of the body part which are remote from the base thereof.

8. A terminal as claimed in claim 6, wherein each wire receiving slot is formed with a laterally enlarged wire strand nest between the wire receiving mouth of the slot and the base of the body part.

9. A terminal as claimed in claim 6, wherein the side walls of the body part are planar and extend normally of the base of the body part, the side walls of the spring part each having an edge engaging the outer face of a respective side wall of the body part but being otherwise parallel to the respective side wall.

10. A terminal as claimed in claim 6, wherein the spring part is releasably connected to the body part by means of projections thereon which engage in openings in the side walls of the body part.

11. A terminal as claimed in claim 10, wherein the openings are in the form of slots formed in the side walls of the body part at positions proximate to those edges of the side walls which are remote from the base of the body part.

* * * * *